US005348409A

United States Patent [19]

Newman, Sr. et al.

[11] Patent Number: 5,348,409

[45] Date of Patent: Sep. 20, 1994

[54] LIQUID RESERVOIR BRUSH

[76] Inventors: Robert D. Newman, Sr.; Robert D. Newman, Jr., both of P.O. Box 377, Greenwood, Mo. 64034

[21] Appl. No.: 89,778

[22] Filed: Jul. 12, 1993

[51] Int. Cl.[5] ..... A46B 11/02; A46B 11/06

[52] U.S. Cl. ..... 401/42; 401/43

[58] Field of Search ..... 401/42–47, 401/40, 41

[56] References Cited

U.S. PATENT DOCUMENTS

| | | | |
|---|---|---|---|
| 1,262,539 | 4/1918 | Micka | 401/46 |
| 2,281,484 | 4/1942 | Ellinger | 401/42 X |
| 3,271,809 | 9/1966 | Morawski | 401/43 X |
| 3,806,261 | 4/1974 | Soultanian | 401/42 |
| 4,629,347 | 12/1986 | Poppitz | 401/43 X |

*Primary Examiner*—Steven A. Bratlie

*Attorney, Agent, or Firm*—Hovey, Williams, Timmons & Collins

[57] ABSTRACT

A liquid reservoir brush apparatus includes an elongated body provided with opposed upper and lower surfaces, and a reservoir formed in the upper surface. A fluid inlet is provided which is adapted to be connected through a flow-through handle to a source of fluid, and a fluid outlet is formed in the lower surface of the brush which communicates with the inlet. The reservoir is connected to the fluid passageway by a restricted passageway so that a cleaning fluid in the reservoir is drawn into the flow through the brush during use. A cover is secured to the upper surface of the body and encloses the reservoir. The cover includes a threaded opening in which a valve is positioned. The valve is movable within the threaded opening between a flow-permitting position in which the valve is spaced from the restricted passageway so that the reservoir and fluid passageway are in fluid communication with one another, and a flow-blocking position in which the valve blocks the restricted passageway.

4 Claims, 2 Drawing Sheets

LIQUID RESERVOIR BRUSH

BACKGROUND OF THE INVENTION

1. Field of the Invention

The present invention relates generally to cleaning brushes and, more particularly, to a brush which may be connected to a source of fluid so that the fluid is directed through the brush onto an area to be cleaned.

2. Discussion of the Prior Art

It is known to provide a brush which may be attached to a hollow flow-through handle so that water may be delivered through the handle to the brush and discharged through the brush to facilitate cleaning action carried out by the device.

According to this conventional construction, the brush is provided with an elongated body, a plurality of bristles fastened to the bottom of the body, an inlet to which a hollow handle or other fluid source is attached, and a passageway extending through the body to the bristles so that fluid is discharged adjacent the bristles to facilitate any scrubbing action of the brush.

Unfortunately, it is difficult to use the conventional construction with soaps, detergents, or other cleaning fluids since these fluids must be applied separately to the surface to be cleaned. Thus, extra effort and time is expended, which detracts from the efficiency of the known construction.

OBJECTS AND SUMMARY OF THE INVENTION

It is an object of the present invention to provide a liquid reservoir brush apparatus having a reservoir within which a cleaning fluid is stored, and a means for introducing the cleaning fluid into the flow through the brush so that the cleaning fluid is automatically mixed with the water discharged from the brush.

It is another object of the invention to provide a liquid reservoir brush having a means for regulating the release of cleaning fluid into the water flow through the brush so that a user may control the amount of cleaning fluid used for any particular job. Further, it is an object of the invention to provide a means for allowing the reservoir to be refilled, while the brush presents a low profile permitting the brush to be used in all of the same applications in which conventional brushes are employed.

In accordance with these and other objects evident from the following description of a preferred embodiment of the invention, a liquid reservoir brush apparatus comprises an elongated body including opposed upper and lower surfaces, a reservoir formed in the upper surface, a fluid inlet, a fluid outlet in the lower surface, a fluid passageway connecting the inlet and the outlet, and a restricted passageway connecting the reservoir with the fluid passageway. A plurality of bristles are attached to the body and extend from the lower surface, and a cover is secured to the upper surface of the body and encloses the reservoir. The cover includes a threaded opening in communication with the reservoir, and a valve means is provided in the reservoir for controlling flow between the reservoir and the fluid passageway. The valve means includes a valve having a threaded neck and a gripping means for gripping the valve and threading it into and out of the threaded opening in the cover between a flow-permitting position in which the valve is spaced from the restricted passageway so that the reservoir and fluid passageway are in fluid communication with one another, and a flow-blocking position in which the valve blocks the restricted passageway.

By constructing a brush in accordance with the invention, numerous advantages are achieved. For example, by incorporating a reservoir on the brush and connecting this reservoir with the passageway through the brush, it is possible to introduce a secondary fluid, such as a cleaning fluid or the like, into the primary fluid, e.g. water, as the primary fluid is discharged from the brush. The secondary fluid is introduced automatically, requiring no additional effort of the user, and may be regulated to adjust the amount of secondary fluid mixed with the primary fluid.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

Figure 1:
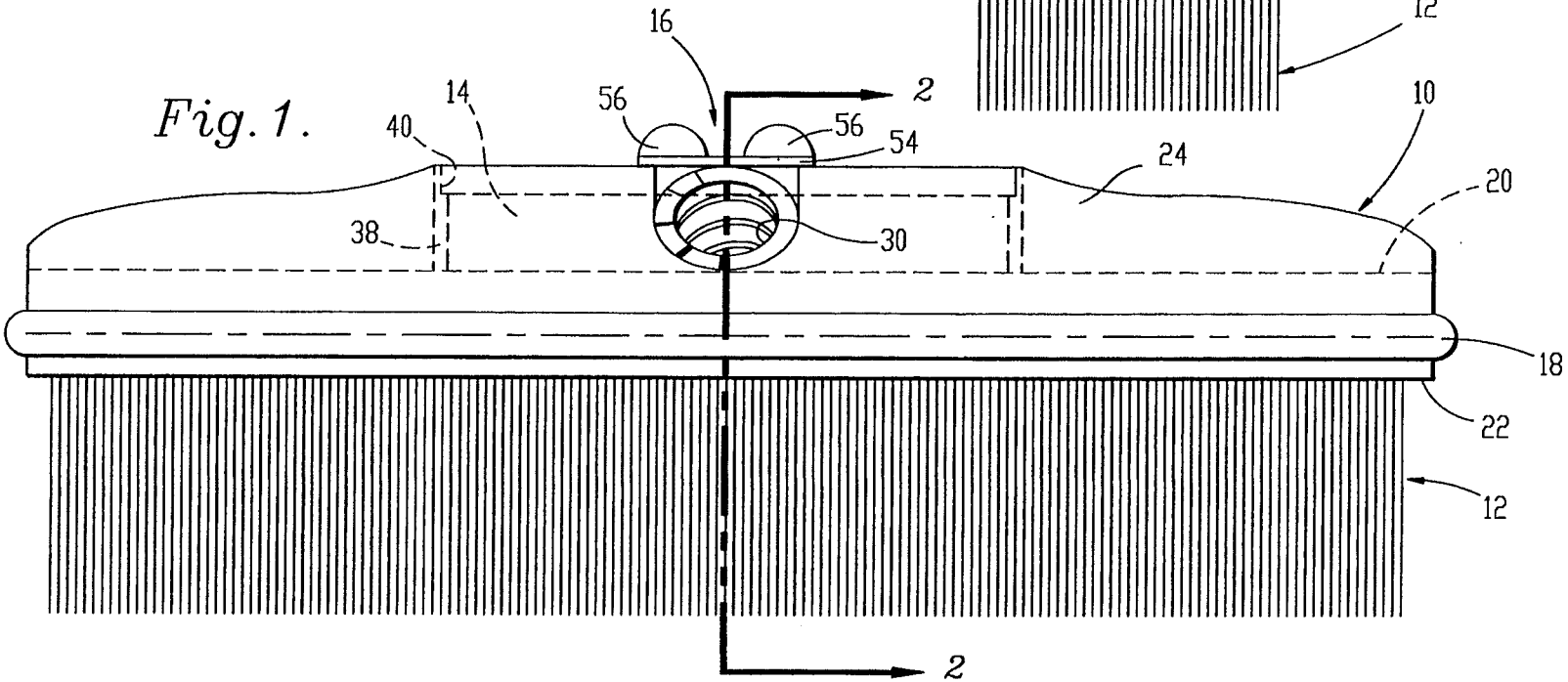
FIG. 1 is a front elevational view of a brush constructed in accordance with the preferred embodiment.

A liquid reservoir brush apparatus constructed in accordance with the preferred embodiment is shown in FIG. 1, and includes a body 10, a set of bristles 12, a reservoir 14, a valve 16, and a bumper 18.

The body 10 includes opposed upper and lower surfaces 20, 22, front and rear side walls 24, 26 extending between the surfaces along the length of the brush. A pair of curved end walls 28 connect the front and rear walls. A threaded fluid inlet 30 is formed in the body and extends at an angle to the upper and lower surfaces so that a hollow, flow-through pole 32, shown in FIG. 2, or other fluid source may be connected to the inlet and used as a handle for manipulating the brush.

The threaded inlet is in fluid communication with a passageway 34 extending between the inlet and an outlet 36 provided in the lower surface of the body. The outlet 36 is generally centrally disposed on the lower surface 22 of the brush in the midst of the bristles so that water discharged from the passageway is released through the bristles onto the surface to be cleaned or treated.

Figure 4:
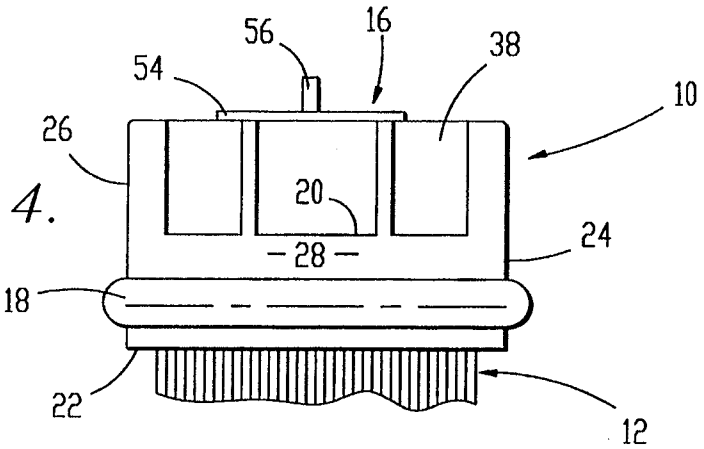
FIG. 4 is a fragmentary end elevational view of the brush.

The reservoir 14 is formed in the upper surface of the body, and preferably is defined by the front and rear side walls 24, 26, as shown in FIG. 1, and by upstanding end walls 38, illustrated in FIG. 4. The walls 24, 26, 38 extend above the upper surface so that the upper surface of the body forms a floor of the reservoir.

Figure 2:
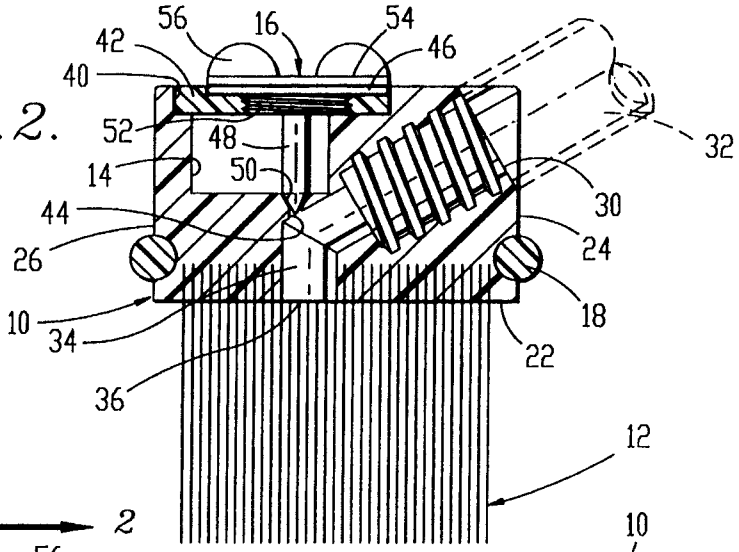
FIG. 2 is a sectional view taken along line 2—2 of FIG. 1.

As shown in FIG. 2, the reservoir includes an upper stepped region 40 extending circumferentially around the top of the reservoir and being countersunk to receive a cover 42. The reservoir also includes a passageway 44 connecting the reservoir 14 with the passageway 34. The passageway 44 includes a circumferential wall that is tapered between a large diameter opening in the chamber and a smaller, restricted orifice in the fluid passageway 34.

Figure 3:
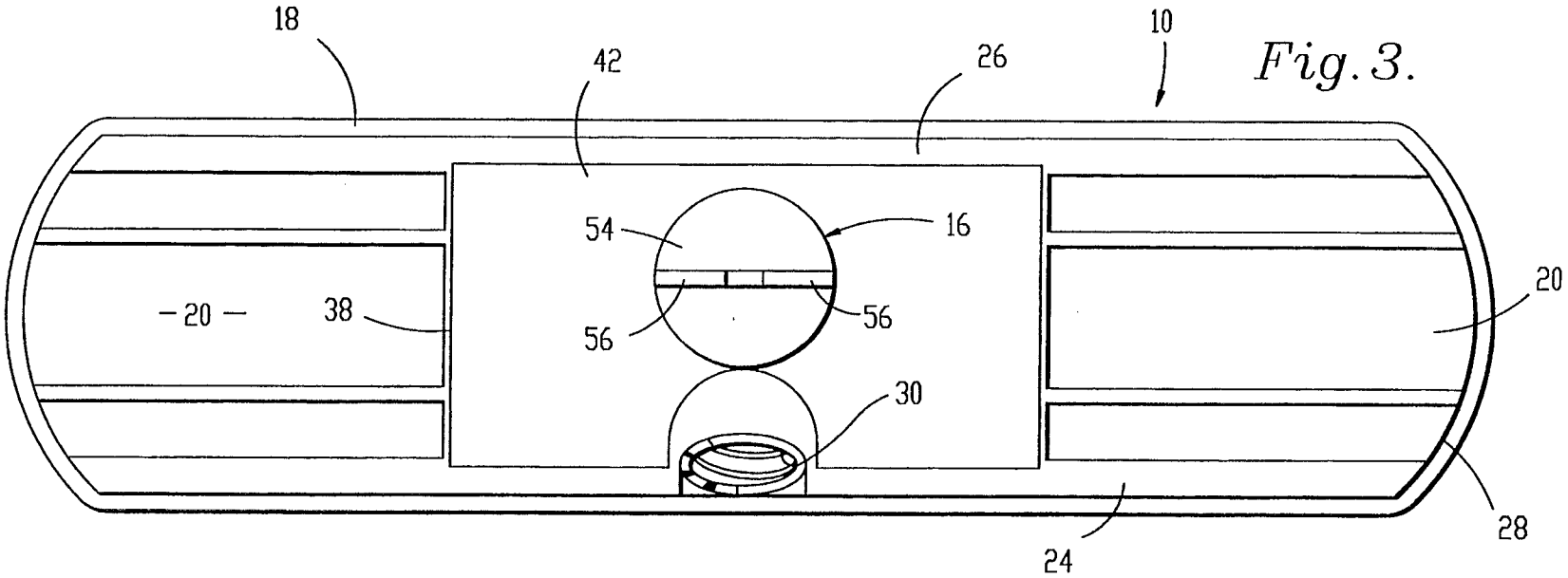
FIG. 3 is a top plan view of the brush.

The cover 42, shown in FIG. 3, is preferably formed of the same material as the body, e.g. a thermoplastic material or the like, and is secured to the body within the countersunk stepped region 40, illustrated in FIG. 2, to enclose and seal the chamber. A threaded opening is formed in the cover and communicates with the chamber. This opening is adapted to receive the valve 16, and includes a stepped, countersunk portion for receiving a resilient O-ring 46.

The bristles 12 are preferably formed of any desired conventional material such as nylon or polyester, and are attached to the body in a conventional manner. The bumper 18 extends completely around the side walls 24, 26, 28 of the body and is formed of a resilient material such as rubber so as to protect the body from damage when the brush contacts foreign objects during use.

The valve is received within the threaded opening of the cover 42 to normally seal the reservoir 14. The valve includes an elongated stem 48 having a conical tip 50 formed at one end thereof, a threaded neck 52 attached to the stem opposite the tip, and a head 54 connected to the neck and provided with gripping means for gripping the valve and threading it into and out of the threaded opening in the cover.

The neck 52 has a diameter substantially equal to the diameter of the opening in the cover, and the head is larger than the neck and presses against the O-ring 46 when the valve is threaded completely into the cover. The gripping means preferably includes a pair of upstanding ears 56 which permit a user to turn the head in either direction.

The stem 48 extends through the reservoir into the passageway, and the conical tip 50 mates with and seats against the tapered wall of the passageway 44 when the valve is threaded completely into the opening. In this position, all flow through the passageway is blocked. However, when the valve is unscrewed, the tip lifts from contact with the passageway surface, allowing fluid to flow past the tip through the passageway. Further, the rate of flow through the passageway may be regulated by adjusting the amount of separation between the valve and the passageway.

Prior to using the brush, the valve 16 is removed from the cover 42, and the reservoir 14 is filled with a cleaning fluid or the like. Thereafter, the valve is replaced and threaded down against the seat defined by the circumferential wall of the passageway 44.

During use, the brush is connected to the hollow, flow-through handle 32 that is, in turn, connected to a garden hose or the like. Thus, water is delivered to the inlet 30 via the handle, and is discharged from the outlet 36 through the bristles 12 toward a surface to be cleaned so that the brush may be applied to the surface at the same point at which the water is directed.

If it is desired to add cleaning fluid or the like from the reservoir into the water stream, the valve 16 is loosened slightly to lift the tip 50 from the passageway 44 so that fluid within the reservoir may be drawn in to the water stream by the pressure differential between the fluid being discharged and the fluid in the reservoir. A slight vacuum is formed in the reservoir during this process, and prevents fluid in the chamber from dripping freely from the reservoir after the water supply is turned off.

Although the invention has been described with reference to the preferred embodiment illustrated in the attached drawing figures, it is noted that substitutions may be made and equivalents employed herein without departing from the scope of the invention as recited in the claims.

What is claimed is:

1. A liquid reservoir brush apparatus comprising:

an elongated body including opposed upper and lower surfaces, a reservoir formed in the upper surface, a fluid inlet, a fluid outlet in the lower surface, a fluid passageway connecting the inlet and the outlet, and a restricted passageway connecting the reservoir with the fluid passageway;

a plurality of bristles attached to the body and extending from the lower surface;

a cover secured to the upper surface of the body and enclosing the reservoir, the cover including a threaded opening in communication with the reservoir; and a valve including an elongated stem, a threaded neck from which the stem extends, and a gripping means for gripping the valve and threading the valve into and out of the threaded opening between a detached position in which the valve is completely unthreaded from the opening to permit filling of the reservoir, a first sealed position in which the valve seals the opening and the stem is spaced from the restricted passageway to allow fluid flow between the reservoir and the fluid passageway, and a second sealed position in which the valve seals the opening and the stem closes off the restricted passageway to block fluid flow between the reservoir and the fluid passageway.

2. A liquid reservoir brush apparatus as recited in claim 1, herein the valve includes a head on which the gripping means is provided, the apparatus further comprising a seal positioned between the head of the valve and the cover for sealing the threaded opening.

3. A liquid reservoir brush apparatus as recited in claim 1, wherein the restricted passageway includes a tapered wall, and the valve includes a stem having a conical tip which seats against the tapered wall of the restricted passageway when the valve is in the flow-blocking position.

4. A liquid reservoir brush apparatus as recited in claim 3, wherein the position of the stem relative to the restricted passageway is adjustable between a plurality of flow-permitting positions for controlling flow between the reservoir and the fluid passageway.

* * * * *